United States Patent [19]

Kieferle

[11] Patent Number: 4,910,821

[45] Date of Patent: Mar. 27, 1990

[54] SCREEN INSTALLERS TOOL

[76] Inventor: Ralph M. Kieferle, 2200 Corporation Blvd., Naples, Fla. 33942

[21] Appl. No.: 341,829

[22] Filed: Apr. 24, 1989

[51] Int. Cl.[4] ..... B26B 11/00

[52] U.S. Cl. ..... 7/158; 81/488; 29/235

[58] Field of Search ..... 7/103, 105, 158; 81/488; 29/235; 30/162, 335

[56] References Cited

U.S. PATENT DOCUMENTS

| | | | |
|---|---|---|---|
| 3,541,660 | 11/1970 | Soto | 29/235 |
| 4,028,758 | 6/1977 | O'Conner | 7/158 |
| 4,197,605 | 4/1980 | King | 7/158 X |
| 4,761,882 | 8/1988 | Silverstein | 30/335 X |

*Primary Examiner*—James G. Smith

[57] ABSTRACT

A screen installer's tool for use when installing screening material in a frame. The tool is designed to be held in the hand with a knife blade at one end and a rotatable screen forming wheel at the other end. The body of the tool is made in two parts joined together by screws with an internal compartment which houses a supply of knife blades and also a slidable knife blade carrier. The carrier includes a finger-operable detent and pawl for permitting slidable movement of the carrier and knife blade in and out of the internal compartment so that when not in use the knife blade is locked in place within the tool body.

4 Claims, 1 Drawing Sheet

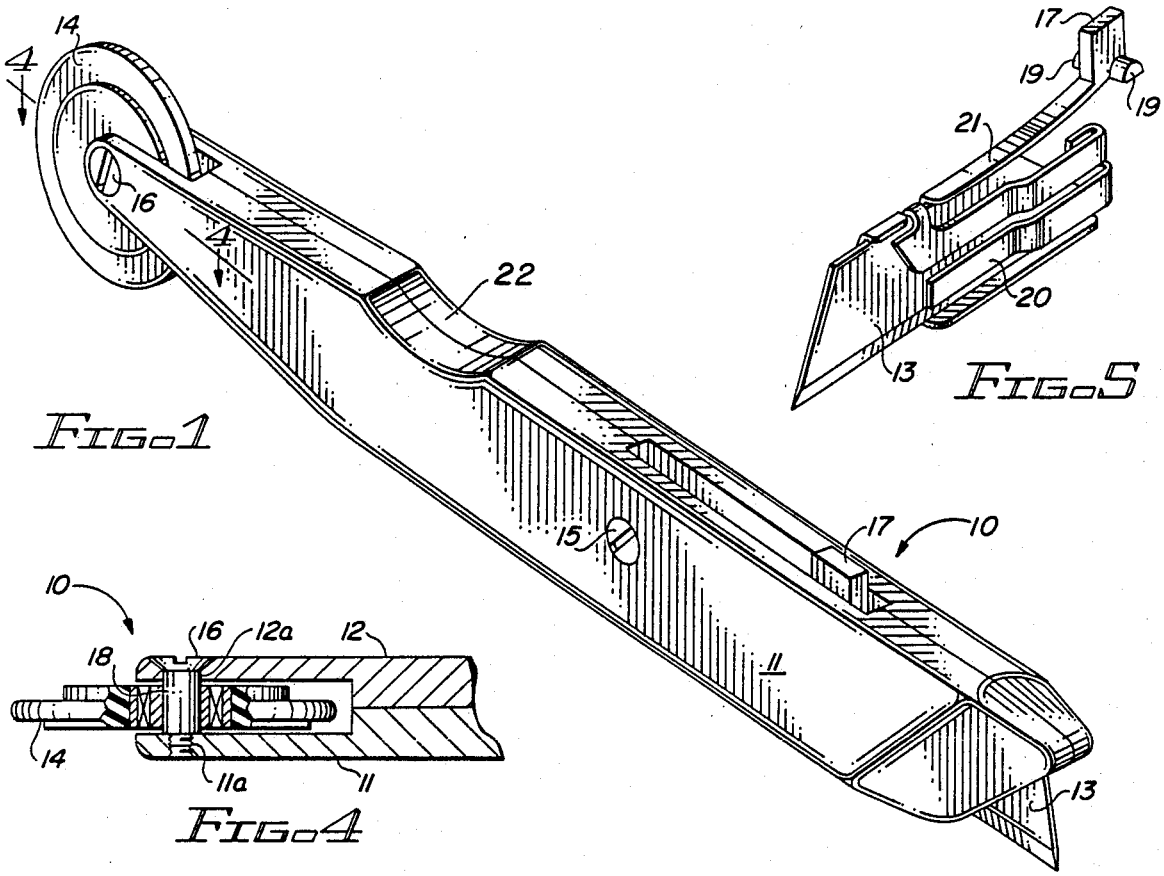
FIG. 1
FIG. 5
FIG. 4
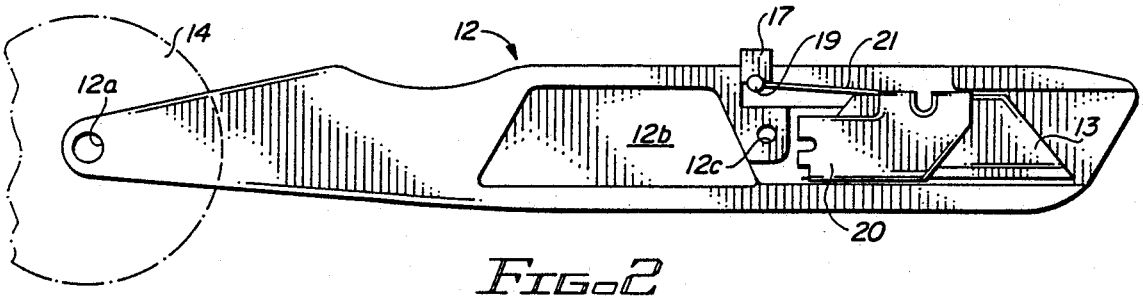
FIG. 2
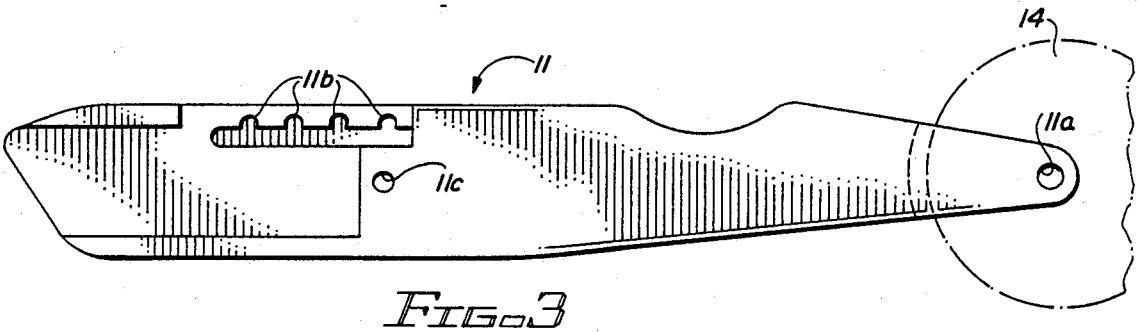
FIG. 3

SCREEN INSTALLERS TOOL

BACKGROUND AND SUMMARY OF THE INVENTION

My invention relates to a tool for use by a screen installer when installing screening material into a frame.

The installation of screening material into the frames of window and door screens and in the panels used to screen lanais and swimming pool enclosures often involves many man hours of hand labor by screen installers.

In most cases, those persons who are skilled as screen installers use two tools. First, a knife to cut the screening material, usually plastic or synthetic rubber, to a desired size and secondly, rotatable screen forming wheel used first to press the screening material into the elongated grooves in the screen frame and then to force a length of synthetic bead into the grooves on top of the screening material and thus lock the screening material into the frame.

The use of two separate tools for installing screening material into screen frames is both inconvenient and time consuming. Tools can be out of reach, lost or misplaced, causing delays and irritation which add to the cost of the job.

I have invented a unique tool for use by screen installers which eliminates such delays and irritations and substantially reduces the time involved in installing screening material into screen frames. In addition the unique shape of my tool permits increased pressure by the screen forming wheel on the screen material and the bead.

Simply put, my screen installer's tool eliminates the need for two separate tools by incorporating into a single tool a retractable knife blade and a rotatable screen forming wheel. Its elongated tool boy is made of two mating elongated halves joined together by a pair of screws. Preferably the two parts of the tool body are made of aluminum or high density plastic and when joined together form an internal compartment which houses a slidable knife blade carrier and also a supply of extra knife blades.

The slidable blade carrier includes a finger-operable detent and pawl which permits the carrier's supported knife blade to move in and out of one end of the tool body from within the tool body's compartment and be locked into position either within the tool body or with the knife protruding from one end of the tool body.

An axle located at the other end of the tool body preferably supported on one of the body fastening screws supports the rotatable screen forming wheel. Because of an indented notch in the tool body which fits into the palm of the installer's hand, the screen installer using my tool is able to put additional pressure on the wheel to aid in forcing the screening material and also the bead into the grooves of the screen frame.

The detent is positioned so that it can be conveniently operated by a thumb or finger of the hand which grips the body of the tool without the necessity of re-positioning the tool regardless of whether the installer is using the knife or the wheel.

BRIEF DESCRIPTION OF THE DRAWINGS

Referring now to the accompanying drawings:

FIG. 1 s an overall perspective view of a preferred embodiment of my screen installer's tool;

FIG. 2 is an elevational side view of the tool shown in FIG. 1 with one of the two halves of the tool body and the screen forming wheel removed in order to show the internal compartment for storing extra blades with the knife blade and its carrier retracted within the tool body;

FIG. 3 is an elevational side view of the tool body half which was removed from FIG. 2;

FIG. 4 is a detailed view partially in cross-section taken along line 4—4 of FIG. 1 showing the mounting of the rotatable screen forming wheel onto the tool body; and FIG. 5 is a detailed perspective view of the knife blade and knife blade carrier shown in FIG. 2.

DETAILED DESCRIPTION OF THE PREFERRED EMBODIMENT

FIG. 1 of the drawings illustrates a preferred form of my screen installer's tool 10 with knife blade 13 shown extending from the front end of the elongated tool body.

The tool body, preferably made of aluminum or a high density plastic material, consists of two mating halves 11 and 12 removably joined together by two screws 15 and 16 located respectively near the middle of the tool body and at its rear end. Rear screw 16 supports an axle 18 which in turn supports rotatable screen forming wheel 14 as best shown in FIG. 44.

The tool body is uniquely formed so as to fit into the hand of a screen installer so that he or she will be able to utilize both the knife blade and the screen forming wheel sequentially without changing the position of the tool in the hand. Pawl 17, which controls the position of knife blade 13, is located conveniently for operation by the thumb or finger without changing the position of the hand gripping the tool to utilize the knife blade and the wheel. Likewise, the tool body includes a depression or notch best shown in FIG. 1 near the wheel-mounted end of the tool which fits into the palm of the hand to enable the screen installer to put additional pressure on the wheel when forcing the screening material and then the bead into the grooves of the screen frame, while using only the one hand.

FIGS. 2 and 3 show the details of tool body halves 11 and 12. Tool half 12 include near its middle tapped screw hole **12*c* for receiving screw 15 and also at its rear end screw hole 12*a* for receiving screw 16 which supports wheel axle 18 and wheel 14. As shown in FIG. 2, tool half 12 includes a cavity which with a mating cavity in tool half 11 forms a hollow elongated internal compartment 12*b*** in tee tool body.

The internal compartment shown in FIGS. 2 and 3 houses slidable carrier 20 for knife blade 13 as best shown in FIG. 2 and also includes space to the rear of carrier 20 for storing extra blades.

Knife blade carrier 20 is moved forth and back within compartment **12*b* by means of a finger or thumb-operated detent 17 located on the end of spring 21 attached to carrier 20 as best shown n FIG. 5. In order to lock knife blade 13 into one of several alternative positions, i.e., fully retracted into the tool body, partially extended from the front end of the tool body or fully extended, a pawl 19 projects from both sides of the lower end of detent 17 which by the action of spring 21 guides and positions pawl 19 into the appropriate one of several grooves 11*b* as shown in FIG. 3 to lock the knife 13** into the desired position.

Screen forming wheel 14 includes a roller bearing mounted on an axle 18 as show in FIG. 4. Axle 18 is in turn supported by rear screw 16.

I have found that use of a prototype of my screen installer's tool reduces markedly the time required by a skilled screen installer to do a particular job. While it is difficult to say exactly the amount by which the time of the job can be reduced, I have found that on the average I have been able to reduce the time for installing screening material into screen frames by about fifteen percent. In addition, the cost of my screen installer's tool is less than the combined cost of the two conventional tools, namely, a suitable knife and a screen roller, needed to install screening into frames.

While I have shown and described a preferred embodiment of my screen installer's tool it will be apparent to those skilled in the art that various changes in design and rearrangement of its components may be made without departing from the spirit of the invention. Accordingly, nothing shown and described is intended to limit my invention, whose true scope is set forth only in the appended claims.

I claim:

1. A screen installer's tool containing a knife blade and a rotatable screen forming wheel comprising a two part two ended elongated tool body adapted to be held in one hand and containing a hollow elongated internal compartment, screw means for securely holding the two parts of the tool body together, a slidable knife blade carrier which includes a finger-operated detent and pawl for permitting slidable movement of the carrier and knife blade within the compartment and one end of the tool body, an axle mounted on the other end of the elongated tool body for rotatably supporting the rotatable screen forming wheel, and a depression close to said other end of said tool body for fitting into the palm of the hand.

2. A screen installer's tool as set forth in claim 1 wherein the hollow elongated internal compartment includes a space designed to hold and store a plurality of extra knife blades.

3. A screen installer's tool as set forth in claim 1 wherein the screw means for holding the tool body together consists of two screws, one screw located at one end of the tool body and supporting the axle of the rotatable screen forming wheel and a second screw located near the middle of the tool body.

4. A screen installer's tool containing a knife blade and a rotatable screen forming wheel comprising a two part two ended elongated tool body designed to be held in one hand of a screen installer and containing a hollow elongated compartment opening at one end of the tool body, screw means for securely holding the two parts of the tool body together, a slideable knife blade carrier within the internal compartment of the tool body, a finger-operatable detent and pawl attached to the carrier by a leaf spring for permitting slidable movement of the carrier within the compartment and for locking the carrier and knife blade into one of several predetermined positions, said detent and pawl being so located as to be operable by the finger or thumb of the hand gripping the tool body when using either the knife blade of the wheel of the tool, an axle mounted on the other end of the tool body for rotatably supporting the rotatable screen forming tool, and a depression close to said other end of said tool body for fitting into the palm of the hand.

* * * * *